US010727011B2

(12) United States Patent
Erdloff et al.

(10) Patent No.: US 10,727,011 B2
(45) Date of Patent: Jul. 28, 2020

(54) SWITCH ASSEMBLY FOR OPERATING A MOTOR VEHICLE COMPONENT

(71) Applicant: PREH GMBH, Bad Neustadt a. d. Saale (DE)

(72) Inventors: Dirk Erdloff, Fuldea (DE); Sebastian Schäfer, Hohenroth (DE); Henry Hinterholzinger, Georgensgmünd (DE)

(73) Assignee: PREH GMBH, Bad Neustadt a. d. Saale ( * ) Notice: Subject to any disclaimer, the term of this patent is extended or adjusted under 35 U.S.C. 154(b) by 0 days.

(21) Appl. No.: 16/374,074

(22) Filed: Apr. 3, 2019

(65) Prior Publication Data

US 2019/0318889 A1 Oct. 17, 2019

(30) Foreign Application Priority Data

Apr. 12, 2018 (DE) ..... 10 2018 108 660

(51) Int. Cl.
*H01H 13/80* (2006.01)
*H01H 13/803* (2006.01)

(52) U.S. Cl.
CPC ..... *H01H 13/80* (2013.01); *H01H 13/803* (2013.01); *H01H 2213/00* (2013.01)

(58) Field of Classification Search
CPC .. H01H 13/80; H01H 13/803; H01H 2213/00; H01H 13/702; H01H 13/785; H01H 2201/032; H01H 2209/002
USPC ..... 200/329
See application file for complete search history.

(56) References Cited

U.S. PATENT DOCUMENTS 4,839,474 A * 6/1989 Hayes-Pankhurst ..... H01H 13/702 200/5 A
5,114,790 A 5/1992 Corbett
5,612,692 A * 3/1997 Dugas ..... H01H 13/705 341/22
8,283,582 B2 * 10/2012 Chen ..... H01H 13/703 200/5 A

FOREIGN PATENT DOCUMENTS

CH 658744 11/1986
DE 19529492 A1 2/1997
DE 602005001789 12/2007
(Continued)

*Primary Examiner* — Edwin A. Leon
(74) *Attorney, Agent, or Firm* — M&B IP Analysts, LLC

(57) ABSTRACT

The present disclosure relates to a switch assembly for a motor vehicle component, including: an electronic basic body for arranging a contact member; an actuating member for actuating the contact member; a web associated with the actuating member, including a web portion with a web stop; a flexible switching mat having a basic portion for arranging the actuating member and the web; an operating member having an operating portion with an operating stop and an operating counter-stop disposed opposite to the web stop; a support member connected to the basic body or the switching mat having a support portion with a support counter-stop that contacts the operating stop in a non-actuated state of the switch assembly; wherein the web provided on the basic portion is arranged to be spaced apart from the actuating member provided on the basic portion, wherein the web encloses the actuating member at least partially.

14 Claims, 2 Drawing Sheets

(56) References Cited

FOREIGN PATENT DOCUMENTS

| | | | |
|---|---|---|---|
| DE | 102008003264 | A1 | 7/2009 |
| EP | 1387375 | A2 | 2/2004 |

* cited by examiner

SWITCH ASSEMBLY FOR OPERATING A MOTOR VEHICLE COMPONENT

CROSS-REFERENCE TO RELATED APPLICATIONS

This application claims priority to the German Application No. 10 2018 108 660.1, filed Apr. 12, 2018, now pending, the contents of which are hereby incorporated by reference.

TECHNICAL FIELD

The present disclosure relates generally to a switch assembly, and more particularly, a switch assembly for operating a motor vehicle component.

BACKGROUND

A switch assembly for operating a motor vehicle component is known from the prior art. The switch assembly comprises an operating member configured as a tappet, which serves for operating an actuating member configured as a lifting bellows. Together with a basic portion, the lifting bellows forms a switching mat, wherein the lifting bellows is provided for actuating a snap dome disposed on an electronic circuit board, wherein the snap dome is disposed in the switching mat. A support member is provided for partially accommodating the lifting bellows and the tappet. Furthermore, a web configured as a tolerance-compensating means is provided, which is disposed on the lifting bellows in a peripherally extending manner. The web serves to connect the lifting bellows, the snap dome and the tappet, to the support member in a rattle-proof manner. In this case, during production, the web is braced with the support member and the tappet in such a way that the lifting bellows, particularly the web, is mechanically braced against the tappet and the support member.

If the operating member is actuated by a user, the lifting bellows and the web move towards the snap dome, wherein the lifting bellows is first supported by the snap dome. Then, the web is compressed because both the web and the lifting bellows are pressed further in the direction of the snap dome during the actuation of the lifting bellows by the operating member. When the force acting on the lifting bellows increases, the snap dome buckles. In the process, the energy stored in the web due to the compression is also abruptly released when the snap dome buckles, so that the snap dome is additionally accelerated. Consequently, an undesirably loud noise occurs due to the clicking noise of the snap dome. The metallic clicking noise is perceived by some users as very annoying, particularly when other noises in the inner space of the motor vehicle are comparatively quiet.

It is therefore the object of the present disclosure to provide a switch assembly in which the noises upon actuation by a user are reduced.

SUMMARY

The object is achieved by the characterizing portion of patent claim 1. In this case, it is provided that the web provided on the basic portion of the switching mat is arranged so as to be spaced apart from the actuating member provided on the basic portion of the switching mat, wherein the web encloses the actuating member at least partially, preferably completely. The noises, for example in an inner space of a motor vehicle, can be reduced and preferably eliminated by the switch assembly according to the present disclosure. This increases user comfort because the metallic clicking noise, e.g. of the snap dome, is at least partially minimized. This is ensured by the fact that even though the web, which is preferably configured as a tolerance-compensating member, is also compressed when the operating member is actuated, a release of the energy produced and stored in the web due to compression is prevented when the contact member is switched, particularly when the snap dome buckles in the direction of the basic body. Since the web is disposed on the basic portion of the switching mat, a direct transmission of forces from the web to the contact member in the case of an actuation of the operating member is advantageously excluded, and an additional acceleration acting on the contact member through the web is thus prevented.

For example, the switch assembly can be used in an inner space, in particular an inner compartment, of a motor vehicle. In this case, it may be an option if the switch assembly is provided, for example, for operating an air-conditioning system, a steering wheel switching unit, a radio system and/or a navigation system. Particularly in the case of electric vehicles, the use of the switch assembly according to the present disclosure may be very appropriate because the driving noises in these vehicles are very quiet due to the electric motor, and therefore, any metallic noises, particularly metallic clicking noises of the switch assembly, are perceived as very annoying by the user.

The switching mats may preferably be silicone switching mats. Silicone switching mats are generally made from elastic, non-toxic silicone rubber compositions and produced or processed in printing or injection-molding processes. Above all, the silicone switching mats have an excellent temperature and aging resistance. Motor vehicles specifically, in particular electric vehicles, are also driven under extreme conditions, such as at very high temperatures in the desert, or at very cold temperatures in the frosty winter. The assembly and arrangement of contact members, particularly of snap domes, in the switching mat, particularly in the silicone switching mat, can be carried out easily and cost-effectively.

Furthermore, the costs can be reduced using the switching mats, preferably the silicone switching mats, particularly if the switch assembly according to the present disclosure is provided for smaller, medium-sized and large motor vehicle series.

According to a preferred embodiment of the switch assembly, it may be provided that, in the non-actuated state of the switch assembly, the actuating member remains in a substantially tension-free rest state and, at the same time, the web stop contacts the operating counter-stop in such a way that the web is elastically biased and the operating stop is pressed in the process against the support counter-stop. It is possible by this measure to ensure in an advantageous manner that at least the actuating member, the contact member and the operating member are disposed within the support member in a secure and rattle-proof manner. Thus, unwanted noises can be prevented even in the non-actuated state of the switch assembly, because the operating member, the contact member and the operating member remain motionless and support one another in the support member in the non-actuated state of the switch assembly. In this case, the height of the web should be at least as great as, preferably greater than, the height of the non-actuated operating member. In this case, the web then also acts as a tolerance-compensating member when assembling and attaching the support member to the basic portion and/or to the basic body.

Only in rare cases are the actuating member, the contact member and the operating member adapted to one another in such a way that they can be placed in the support member in a rattle-proof manner together. Therefore, the web is an absolute requirement in the case of a series production in the motor vehicle sector in order to compensate the tolerances of the components disposed in the support member.

The haptics when actuating the operating member can be advantageously improved if, in the actuated state of the switch assembly, the support counter-stop is disposed so as to be spaced from the operating stop and the bias of the web is increased in the process. Therefore, the user has to exert a pre-defined force in order to actuate the contact member, in particular the snap dome. As a result, an accidental and inadvertent actuation of the switch assembly can be prevented if the bias of the web is increased.

According to another preferred embodiment of the switch assembly, it may be provided that, in the non-actuated state of the switch assembly, the actuating member, in a tension-free manner, rests against the operating member or is spaced apart from it. If, in the non-actuated state of the switch assembly, the actuating member rests on the operating member or is spaced apart from it in a tension-free manner, the life of the actuating member can be extended and/or a substantially constant elasticity of the actuating member can be ensured over several years.

The formation of a vacuum within the support member can be advantageously prevented if the operating member comprises a venting duct which preferably adjoins the actuating member. The noises when actuating the switch assembly are further reduced also by means of this advantageous measure.

In the non-actuated state of the switch assembly, the operating member can be specifically and securely supported and mounted on the support member if the support counter-stop and/or the operating stop are formed as an at least partially peripherally extending projection, in particular a round, preferably circular projection. The peripherally extending projection, which has the cross-sectional shape of a hill, may also serve as a tolerance-compensating member for mounting the operating member, the actuating member and the contact member in the support member in a rattle-proof manner. In this case, for example, the height of the projection in cross section may be one quarter of the height of the web. Given this size ratio of the web and the projection, pleasant haptics when actuating the switch assembly can be obtained.

According to another preferred embodiment of the switch assembly, it may be provided that the operating member is formed from a harder material than the switching mat. This advantageous embodiment of the switch assembly prevents energy, which could later accelerate the motion of the contact member, from being stored in the operating member when it is actuated. Polyethylene (PE), for instance, is an option for the material for the operating member. However, other hard plastics may also be processed when producing the operating member. Consequently, the operating member has a higher Shore hardness value than the switching mat, which is preferably formed from silicone.

The operating member can be precluded from becoming jammed in the support member if the support member has a guide channel for guiding the operating member. The guide channel could also be provided with a lubricant, such as grease. Because of the tolerances of the components with respect to one another, in particular the support member and the operating member, it should preferably be ensured that a gap is provided between the guide channel and the operating member disposed therein. The operating member becoming jammed in the guide channel would unnecessarily increase the ambient noise in the inner space of the motor vehicle and negatively affect the haptics of the switch assembly.

The switch assembly can be designed to be cost-effective and simple if the actuating member is configured as a lifting bellows, which has a jacket surface connected to the basic portion of the switching mat. Preferably, the jacket surface has a wall thickness in cross section which substantially corresponds to the wall thickness of the web. As a result, the haptics of the operating member can be further improved. For this reason, it may also be provided that the lifting bellows is formed as a blunt and/or hollow cone, which has a cylindrical appendage.

According to another preferred embodiment of the switch assembly, it may be provided that the web is connected to the basic portion. It is an option to form the switching mat integrally from a single material, wherein the web and/or the operating member are an integral component of the switching mat.

The switch assembly may have a compact structure if the web is disposed between the actuating member, in particular the jacket surface of the lifting bellows, and the support member. This arrangement of the web precludes the energy stored in the web from being abruptly released when the operating member is actuated. Though the web may be a component of the switching mat, it should advantageously be prevented that the web is a component of the actuating member that is moved along together with the actuating member in the direction of the contact member when the switch assembly is actuated. An acceleration of the contact member by the web is precluded by means of this advantageous arrangement of the web.

According to another preferred embodiment of the switch assembly, it may be provided that the web is formed to be tubular and the cylindrical appendage is disposed within the tubular web and concentrically therewith. Furthermore, the tubular configuration of the web can act in a noise-reducing manner when the switch assembly is actuated.

According to another preferred embodiment of the switch assembly, it may be provided that the actuating member has a tubular portion configured for actuating the contact member, in particular the snap dome, wherein the tubular portion is disposed axially relative to the cylindrical appendage. It is thus ensured that the contact member can be actuated safely and accurately.

Furthermore, a switching mat is protected which, at least in one of the above-described embodiments, is disposed in a motor vehicle, in particular in a center console of a motor vehicle and/or on a steering device of the motor vehicle and/or on a dashboard of the motor vehicle.

BRIEF DESCRIPTION OF THE DRAWINGS

The present disclosure as well as the technical environment will be explained in more detail below with reference to the Figures. It must be remarked that the Figures depict particularly preferred embodiments of the present disclosure, but that the present disclosure is not limited thereto. In the Figures.

DETAILED DESCRIPTION

Figure 1:
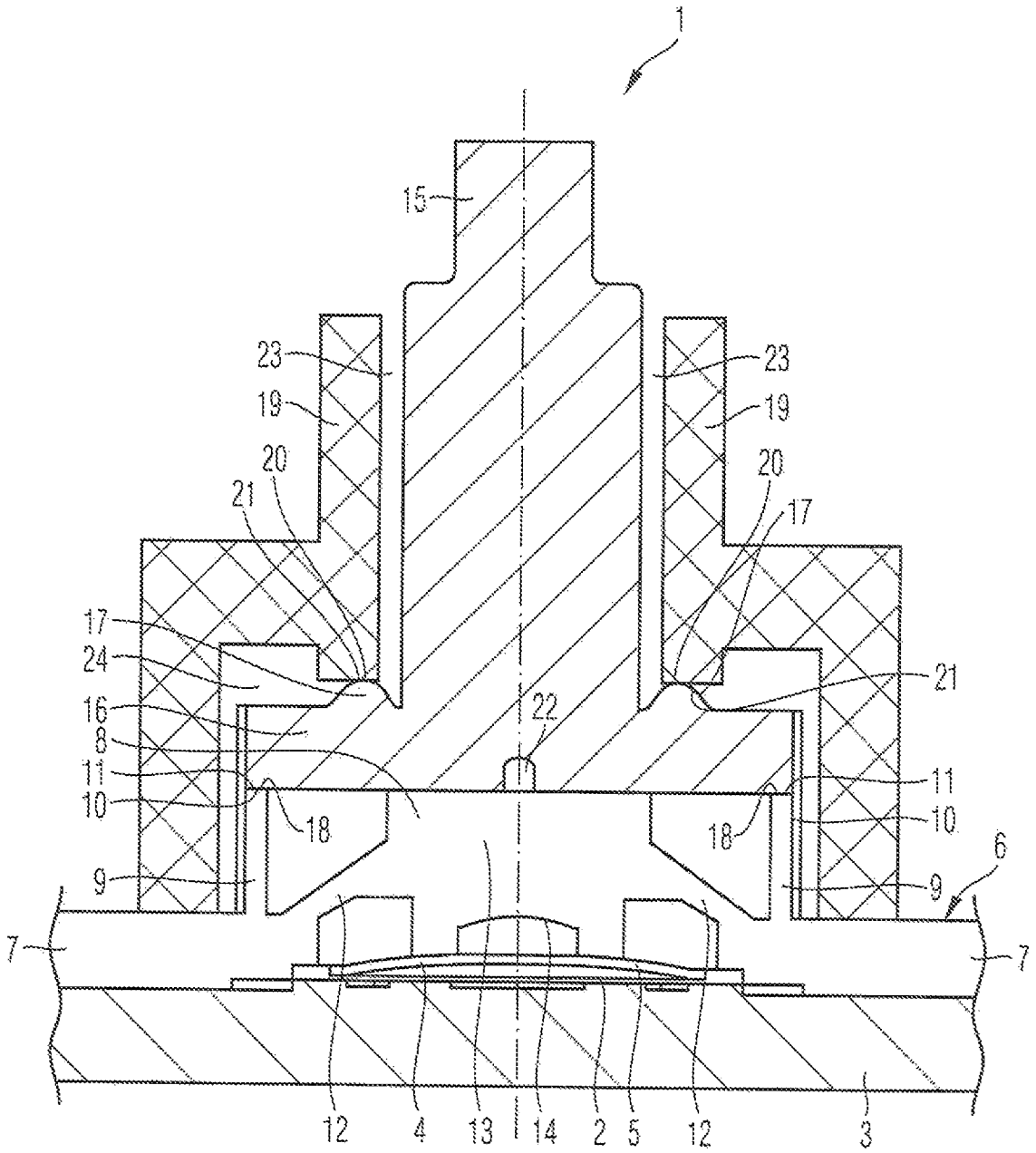
FIG. 1 shows a switch assembly according to the present disclosure in a sectional view.

A switch assembly 1 according to the present disclosure for operating a motor vehicle component is depicted in FIG. 1. For example, the switch assembly 1 can be used in an inner space, in particular an inner compartment, of a motor vehicle. In this case, it may be an option if the switch assembly 1 is provided, for example, for operating an air-conditioning system, a steering wheel switching unit, a radio system and/or a navigation system.

The switch assembly 1 comprises an electronic basic body 3, which is preferably configured as a circuit board 2, for arranging at least one contact member 4, in particular a snap dome 5, and at least one actuating member 8 for actuating the contact member 4. Furthermore, the switch assembly 1 comprises a switching mat 6, which is formed from a flexible material, preferably from silicone, and which has a basic portion 7 for arranging the actuating member 8 and a web 9 configured in a tubular manner, wherein the web 9 is an integral component of the switching mat 6. In this case, the web 9 is associated with the actuating member 8, wherein the web 9 has a web portion 10 with a web stop 11 and is connected to the basic portion 7. The web 9 provided on the basic portion 7 of the switching mat 6 is arranged so as to be spaced apart from the actuating member 8 provided on the basic portion 7 of the switching mat 6, wherein the web 9 encloses the actuating member 8 at least partially, preferably completely.

In the present case, the actuating member 8 is configured as a lifting bellows, which has a jacket surface 12 connected to the basic portion 7 of the switching mat 6. The lifting bellows is formed as a blunt and hollow cone, which has a cylindrical appendage 13, wherein the cylindrical appendage 13 is disposed within the tubular web 9 and concentrically therewith. The actuating member 8 has a tubular portion 14 configured for actuating the contact member 4, in particular the snap dome 5, wherein the tubular portion 14 is disposed axially relative to the cylindrical appendage 13.

FIG. 1 also visually illustrates an operating member 15, which has an operating portion 16 with at least one operating stop 17 and at least one operating counter-stop 18 disposed opposite to the web stop 11 of the web 9, wherein the operating member 15 is formed from a harder material than the switching mat 6. Furthermore, the operating member 15 comprises a venting duct 22 which preferably adjoins the actuating member 8, preferably the operating portion 16.

The switch assembly 1 further comprises a support member 19, which is connected to the basic body 3 and/or the switching mat 6 and has a support portion 20 with at least one support counter-stop 21 that contacts the operating stop 17 of the operating member 15 in the non-actuated state of the switch assembly 1. The support counter-stop 21 and/or the operating stop 17 may be formed as an at least partially peripherally extending projection, in particular a round, preferably circular projection. Consequently, the web 9 is disposed between the actuating member 8, in particular the jacket surface 12 of the lifting bellows, and the support member 19. The support member 19 further has a guide channel 23 for guiding the operating member 15, so that a substantially rectilinear actuation of the operating member 15 is possible.

The emergence of a vacuum within a space 24 of the support member 19 is advantageously prevented by means of the venting duct 22.

Figure 2:
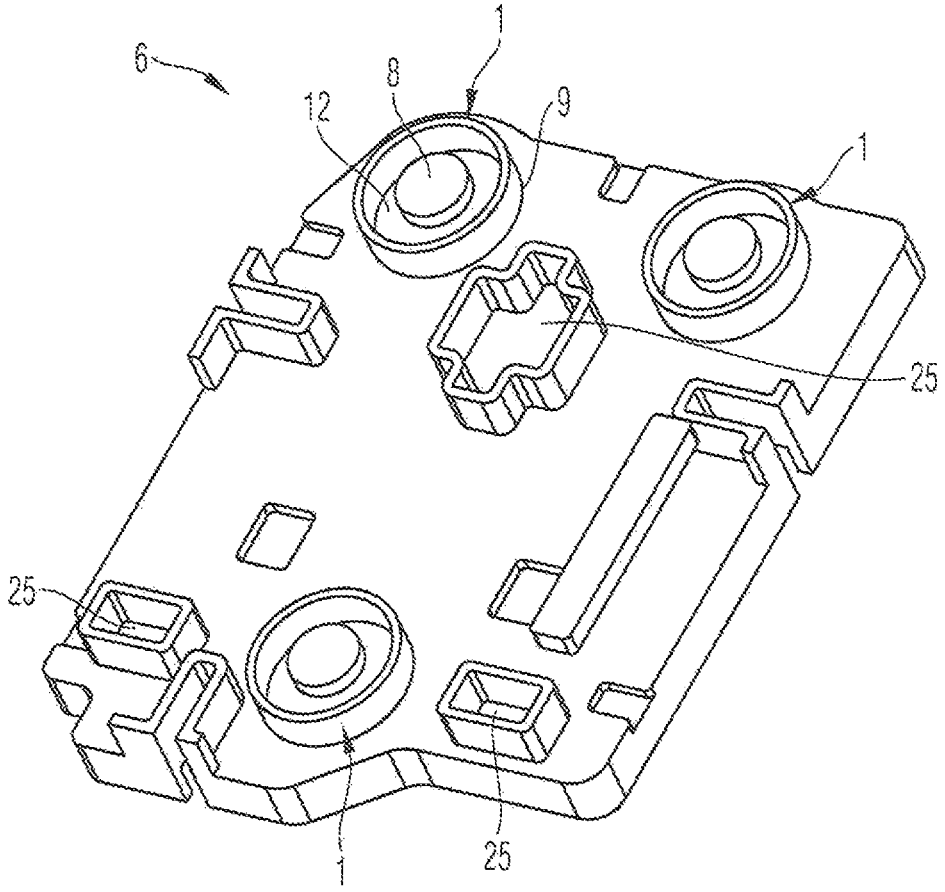
FIG. 2 shows a switching mat for the switch assembly according to the present disclosure in a perspective view.

FIG. 2 depicts a switching mat 6 having three switch assemblies 1 according to the present disclosure. It is also conceivable that the switching mat 6 has more than three switch assemblies 1. The switching mat 6 has through-holes 25 which are configured, for example, for routing therethrough electronic components preferably disposed on the circuit board 2. The switching mat 6 may also include fastening means in order to connect it positively and/or non-positively to the housing and/or the basic body, for example.

The mode of operation of the switch assembly 1 is described below.

In the non-actuated state of the switch assembly 1, the actuating member 8 remains in a substantially tension-free rest state. At the same time, the web stop 11 can contact the operating counter-stop 18 in such a manner that the web 9 is elastically biased and in the process presses the operating stop 17 against the support counter-stop 21. It may also be provided that, in the non-actuated state of the switch assembly 1, the actuating member 8 rests against the operating member 15 in a tension-free manner. If a user actuates the operating member 15 indirectly or directly, the operating member 15 is moved in the direction of the actuating member 8. In the actuated state of the switch assembly 1, the support counter-stop 21 is thus disposed so as to be spaced from the operating stop 17, with the bias of the web 9 being increased in the process. In the process, the web 9 is compressed, wherein, however, the particular arrangement of the web 9 on the basic portion 7 advantageously prevents the energy present and stored in the web 9 from acting on the snap dome 5. It is thus precluded that the snap dome 5 is additionally accelerated by the web 9 during the actuation of the operating member 15, whereby the noises during actuation of the switch assembly 1 can be reduced. During the actuation, the tubular portion 14 of the actuating member 8 acts on the snap dome 5, so that the latter moves in the direction of the circuit board 2 formed as a plate and triggers a switching of a function of the respective motor vehicle component. When the contact between the user and the operating member 15 is terminated, the snap dome 5 moves in the direction of the actuating member 8 and presses the latter in the direction of the operating member 15. In the process, the webs 9 relax and additionally return the operating member 15 and the actuating member 8 back into their respective initial positions. The actuation of the switch assembly 1 is terminated when the operating stop 17 rests against the support counter-stop 21 again.

It could also be provided that the actuating member 8, in particular the tubular portion 14, contacts the contact member 4, in particular the snap dome 5, both in the actuated state and the non-actuated state of the switch assembly 1.

It may be advantageous if the switching mat 6 comprises the web 9, the basic portion 7 and the actuating member 8, wherein the switching mat 6, the web 9, the basic portion 7 and the actuating member 8 together form a single-piece or integral component, which is preferably formed from silicone. In this case, the switching mat 6, the web 9, the basic portion 7 and the actuating member 8 are an integral part of the switching mat 6.

Furthermore, it is very advantageous if the web 9 is configured in a round, preferably circular, manner, as is easy to see in FIG. 2, in order to further reduce the noises when actuating the switch assembly 1.

The invention claimed is:

1. A switch assembly for operating a motor vehicle component, comprising:

an electronic body, which is configured as a circuit board for arranging at least one contact member including a snap dome;

at least one actuating member for actuating the contact member;

at least one web associated with the actuating member and comprising a web portion with a web stop;

a switching mat formed from a flexible material with a portion for arranging the actuating member and the web;

an operating member, which has an operating portion with at least one operating stop and at least one operating counter-stop disposed opposite to the web stop of the web; and a support member connected to at least one of the electronic body or the switching mat, the support member having a support portion with at least one support counter-stop that contacts the operating stop of the operating member in a non-actuated state of the switch assembly, wherein the web provided on the basic portion of the switching mat is arranged so as to be spaced apart from the actuating member provided on the portion of the switching mat, and wherein the web encloses the actuating member at least partially.

2. The switch assembly of to claim 1, wherein in the non-actuated state of the switch assembly, the actuating member remains in a substantially tension-free rest state and, at the same time, the web stop contacts the operating counter-stop in such a way that the web is elastically biased and the operating stop is pressed in the process against the support counter-stop.

3. The switch assembly of claim 1, wherein in the actuated state of the switch assembly, the support counter-stop is disposed so as to be spaced from the operating stop and the bias of the web is increased in the process.

4. The switch assembly of claim 1, wherein in the non-actuated state of the switch assembly, the actuating member rests against the operating member, or is spaced apart from it, in a tension-free manner.

5. The switch assembly of claim 1, wherein the operating member comprises:

a venting duct adjoining the actuating member.

6. The switch assembly of claim 1, wherein the support counter-stop or the operating stop are formed as an at least partially peripherally extending round projection.

7. The switch assembly of claim 1, wherein the operating member is formed from a harder material than the switching mat.

8. The switch assembly of claim 1, wherein the support member includes a guide channel for guiding the operating member.

9. The switch assembly of claim 1, wherein the actuating member is configured as a lifting bellows, which has a jacket surface connected to the portion of the switching mat.

10. The switch assembly of claim 9, wherein the lifting bellows is formed as a blunt and hollow cone, which has a cylindrical appendage.

11. The switch assembly of claim 1, wherein the web is connected to the portion.

12. The switch assembly of claim 1, wherein the web is disposed between the actuating member and the support member.

13. The switch assembly of claim 1, wherein the web is formed to be tubular and the cylindrical appendage is disposed within the tubular web and concentrically therewith.

14. The switch assembly of claim 1, wherein the actuating member has a tubular portion configured for actuating the snap dome of the contact member, wherein the tubular portion is disposed axially relative to the cylindrical appendage.

* * * * *